US005823741A

United States Patent [19]

Predmore et al.

[11] Patent Number: 5,823,741

[45] Date of Patent: Oct. 20, 1998

[54] COOLING JOINT CONNECTION FOR ABUTTING SEGMENTS IN A GAS TURBINE ENGINE

[75] Inventors: Daniel Ross Predmore; Iain Robertson Kellock, both of Clifton Park; Victor Hugo Correia, New Lebanon, all of N.Y.; John Howard Starkweather, Sharonville; Dean Thomas Lenahan, Cincinnati, both of Ohio

[73] Assignee: General Electric Co., Schenectady, N.Y.

[21] Appl. No.: 719,666

[22] Filed: Sep. 25, 1996

[51] Int. Cl.[6] ..... F01D 25/26

[52] U.S. Cl. ..... 415/134; 415/139

[58] Field of Search ..... 415/134, 135, 415/136, 137, 138, 139

[56] References Cited

U.S. PATENT DOCUMENTS

| | | | |
|---|---|---|---|
| 2,863,634 | 12/1958 | Chamberlin et al. | 415/134 |
| 4,537,024 | 8/1985 | Grosjean | 415/139 |
| 4,650,394 | 3/1987 | Weidner | 415/115 |
| 4,676,715 | 6/1987 | Imbault et al. | 415/116 |
| 5,158,430 | 10/1992 | Dixon et al. | 415/134 |
| 5,167,485 | 12/1992 | Starkweather . | |
| 5,374,161 | 12/1994 | Kelch et al. | 415/139 |
| 5,609,469 | 3/1997 | Worley et al. | 415/115 |
| 5,634,766 | 6/1997 | Cunha et al. | 415/115 |

*Primary Examiner*—John T. Kwon
*Attorney, Agent, or Firm*—Nixon & Vanderhye

[57] ABSTRACT

A seal joint including a sealing member for sealing segmented components of a gas turbine engine is spaced from the gas path to provide more effective cooling. The segments include radial extension flanges spacing the seal joint from the gas path. Various cooling arrangements are adaptable to the modified segments to provide for open or closed circuit impingement or convection cooling plus film cooling. Excessive thermal gradients are avoided as the entire corner of the segment is evenly cooled. Moreover, air usage at the joint is bounded by seal leakage with no extra dedicated cooling air.

17 Claims, 2 Drawing Sheets

COOLING JOINT CONNECTION FOR ABUTTING SEGMENTS IN A GAS TURBINE ENGINE

TECHNICAL FIELD

This invention relates to gas turbine engines and, more particularly, to an improved joint connection for the abutting edges of circumferentially extending segments in gas turbine engines such as nozzles, buckets and shrouds.

BACKGROUND

An important consideration in the design of gas turbine engines is to ensure that various components of the engine are maintained at safe operating temperatures. This is particularly true for elements of the combustor and turbine, which are exposed to the highest operating temperatures in the engine, and which include turbine nozzles, buckets and shrouds. The purpose of the turbine nozzle is to direct hot gas at an optimal angle, and within an annular gas path, to cause the adjacent following bucket row to rotate, producing power. The purpose of the shroud is to define the gas path radially outward of the rotating bucket row.

In the turbine section of gas turbine engines, high thermal efficiency is dependent upon high turbine entry temperatures. These entry temperatures, in turn, are limited by the heat which the materials forming the turbine nozzles, buckets and shrouds can safely withstand. In cases in which the gas path temperatures are above the material limitations, the gas path surfaces of these components must be cooled to survive. Thus, in addition to improvements in the types of materials and coatings used to fabricate these components, continuous air cooling has been employed to permit the environmental operating temperature of the turbine to exceed the melting point of the materials forming the components without affecting their integrity.

A number of air cooling techniques have been used in an attempt to effectively and uniformly cool the components of the turbine, combustor and other portions of gas turbine engines. The turbine nozzle segments, for example, are conventionally cooled by a combination of air impingement, film, pin fins and convection/film holes. Each nozzle segment, which comprises inner and outer bands interconnected by fixed nozzle guide vanes, is the beneficiary of a combination of such cooling methods to reduce both the internal and external temperature of the nozzle bands and guide vanes.

One problem area in the cooling of turbine nozzle segments is at the joint connections between adjacent nozzle segments. In order to prevent thermal hoop stresses and to facilitate fabrication, the inner and outer bands supporting the nozzle guide vanes must be segmented, i.e., the nozzles are formed by a number of arcuate segments, each having arcuate-shaped inner and outer bands arranged to extend circumferentially about the turbine case, and abut one another at their side edges. Conventionally, a slot or pocket is formed in each side edge of adjacent turbine nozzle segments and a sealing member is located within and between the cooperating slots of adjacent segments to create a seal therebetween. It has been found, however, that the sealing area between adjacent segments is cooled less effectively than the remainder of the inner and outer bands of the nozzle segments, which creates an uneven heat distribution along the nozzle segments.

Attempts have been made to improve cooling of the joint connection or seal area between abutting turbine nozzle segments, but problems have been encountered with each design. In one design, pressurized air is introduced on the non-gas path side of the sealing member and the resulting leakage to the gas path is used to cool the material. In this design, however, leakage can be unevenly distributed, creating local hot spots, and may lead to "leaky" designs.

Another technique is disclosed in commonly owned U.S. Pat. No. 5,167,485, wherein a number of channels or grooves are formed in the slot of the joint connection forming an airflow path in the seal region such that cooling air is permitted to flow onto one side of the sealing member, into each of the slots in the abutting inner and outer bands of the nozzle segments, around the edges of the sealing member and into the channels or grooves in the inner or outer wall of the slots to the opposite side of the sealing member. Slot cooling, however, requires additional dedicated coolant and results in reduced efficiency.

In another design, the corner adjacent the edge region is overcooled such that the material is cooled by conduction. Conduction cooling, however, can create unacceptable lateral thermal gradients and alone may be insufficient. In yet another method, the material is cooled by film from an adjacent region. Film cooling, however requires additional dedicated coolant and adds manufacturing expense. Air used to cool nozzle, bucket or shroud segment edges by leakage, slots or film bypasses the combustor, thereby increasing emissions and reducing turbine performance. In general, it is advantageous to minimize air usage.

DISCLOSURE OF THE INVENTION

It is, therefore, among the objectives of this invention to provide joint connections between circumferentially arranged segments of turbine (or other rotary machine) components such as nozzles, buckets and shrouds, which effectively cool the seal regions between adjacent segments. In particular, the seal joint having the sealing member therein in accordance with the present invention is located farther away from the gas path than in previous arrangements, creating more room to actively cool the edge. Moreover, excessive thermal gradients are avoided as the entire edge corner is evenly cooled. Air usage at the joint is bounded by seal leakage with no extra dedicated cooling air required.

This and other objects of the invention are achieved by providing, for example, a plurality of circumferentially adjacent nozzle segments, each having a warm side surface and a cool side surface. Each segment includes an inner band, an outer band, and one or more guide vanes extending therebetween. The inner and outer bands each have a pair of side edges or faces which are adapted to substantially abut like edges or faces of adjacent segments.

Each side face of each band is formed with an elongated slot extending axially along the side face, the slot opening toward a corresponding opposing slot in an adjacent face of an adjacent segment. Sealing members are employed between the opposed slots of adjacent segments with a gas path on one side of the sealing member and a non-gas path on the other side.

In exemplary embodiments of this invention, the sealing members in the inner and outer bands are located farther away from the gas path than in previous designs.

In a first exemplary embodiment, a seal joint is defined at a radially outermost end of adjacent radial extension flanges. The radial extension flanges extend outwardly from the adjacent segments radially away from the gas path. Cooling air flows through an impingement plate to cool the sealed joint. In a second exemplary embodiment, film slots are provided in the segments to provide conventional film cooling along with open-circuit impingement or convection cooling. In a third exemplary embodiment, a closed circuit region is provided for closed-circuit impingement or convection cooling. In each configuration, the seal joint is radially spaced from the gas path by an amount substantially corresponding to the length of the radial extension flanges.

In its broader aspects, therefore, the present invention thus relates to a segment for a circumferential component of a rotary machine. The segment includes a longitudinal section extending in a first direction, a seal joint section including a side edge face extending in a second direction substantially perpendicular to the first direction, and a slot formed in the side edge face extending from the face in the first direction, dividing the face into a radially inner face portion and a radially outer face portion. The slot is shaped to receive a sealing member in cooperation with an adjacent slot of the adjacent segment, wherein the radially inner face portion is longer than the radially outer face portion.

In this context, the invention also relates to a gas turbine engine including at least one section having a plurality of the circumferentially adjacent segments.

In another aspect, the invention relates to a segmented component of a turbine engine including a plurality of pairs of adjacent segments, each pair of adjacent segments including a seal joint having a slot therein shaped to receive a seal member. The seal joint is radially spaced from a gas path by an amount sufficient to enable active cooling of the seal joint.

In still another aspect, the invention relates to a method of sealing and cooling circumferentially adjacent segments in a gas turbine engine. The method includes the steps of locating a seal joint slots in adjacent segments, radially spaced from a gas path by an amount sufficient to enable active cooling of the seal joint slots, and inserting a sealing member in the seal joint slots of adjacent segments to seal the adjacent segments.

BRIEF DESCRIPTION OF THE DRAWINGS

The structure, operation and advantages of the presently preferred embodiments of this invention will become further apparent upon consideration of the following description, taken in conjunction with the accompanying drawings, wherein.

BEST MODE FOR CARRYING OUT THE INVENTION

Figure 1:
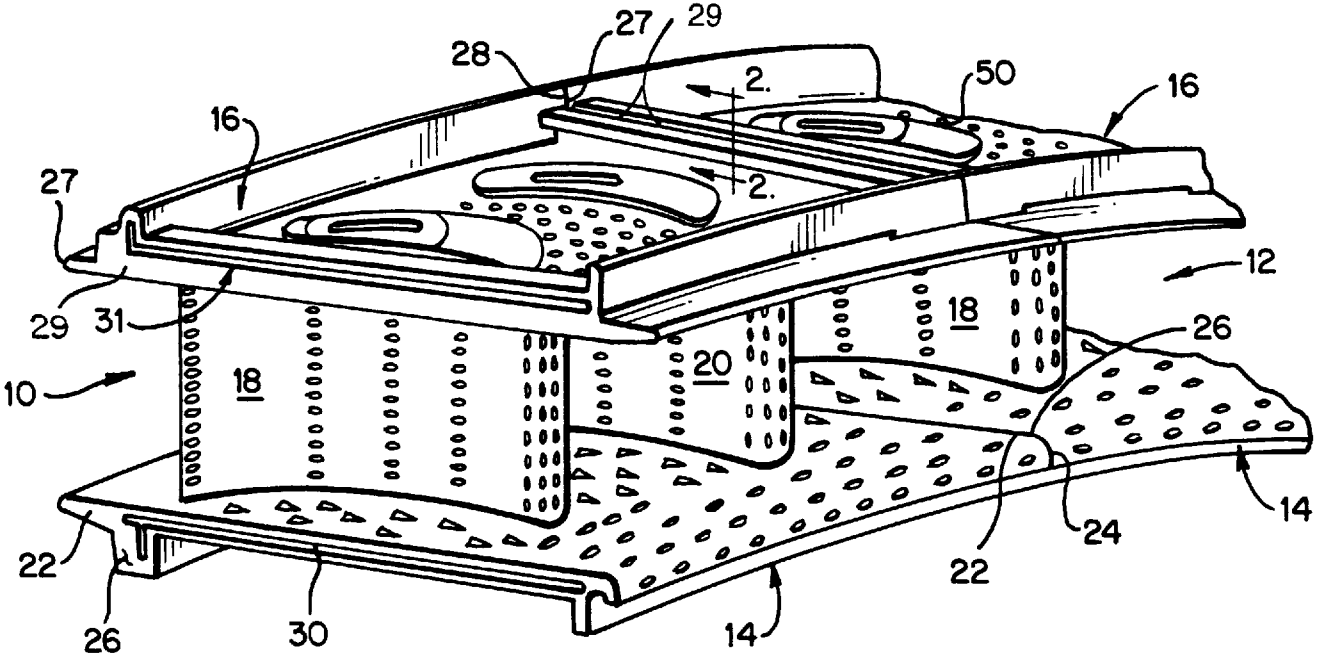
FIG. 1 is a schematic, perspective view of two abutting turbine nozzle segments of a gas turbine engine employing the side edge seal of this invention.

Referring now to FIG. 1, a first turbine nozzle segment 10 and part of a second nozzle segment 12 are shown abutting each other, forming a portion of an essentially continuous, circumferentially extending nozzle stage within the turbine section of a gas turbine engine. For purposes of the present disclosure, only the construction of turbine nozzle segment 10 is discussed in detail, it being understood that the other nozzle segment 12, and all other nozzle segments within the nozzle assembly are structurally and functionally identical. In addition, it is to be understood that the invention here is equally applicable to the construction of annularly segmented turbine buckets and shrouds.

The turbine nozzle segment 10 comprises an inner band 14, an outer band 16 and a pair of nozzle guide vanes 18, 20 connected between the inner and outer bands 14, 16. While a two vane segment is depicted, it is recognized that the segment can have one or any other number of vanes. The inner band 14, outer band 16, and nozzle guide vanes 18 and 20 are shown as including film cooling holes 50 which serve as passages to provide cooling air through the parts for convection cooling and to surfaces exposed to hot gases for film cooling. The inner band 14 of nozzle segment 10 is formed with opposite side edges 22, 24, each having an edge face 26. Similarly, the outer band 16 of nozzle segment 10 is formed with opposite side edges 27, 28 each having an edge face 29. In the assembled position, the side edges 22, 24 of the inner band 14 and the side edges 27, 28 of the outer band 16 of adjacent nozzle segments substantially abut to form an essentially continuous, annular nozzle assembly.

The side edges 22, 24 of the inner band 14 and the side edges 27, 28 of the outer band 16 are each formed with a longitudinally extending pocket or slot 30, 31, respectively. For purposes of the present disclosure, the slot 31 in abutting side edges 27, 28 of the outer bands 16 of segments 10, 12 is described in detail, it being understood that the slots 30 in the inner bands 14 thereof are generally similar in structure and function.

Figure 2:
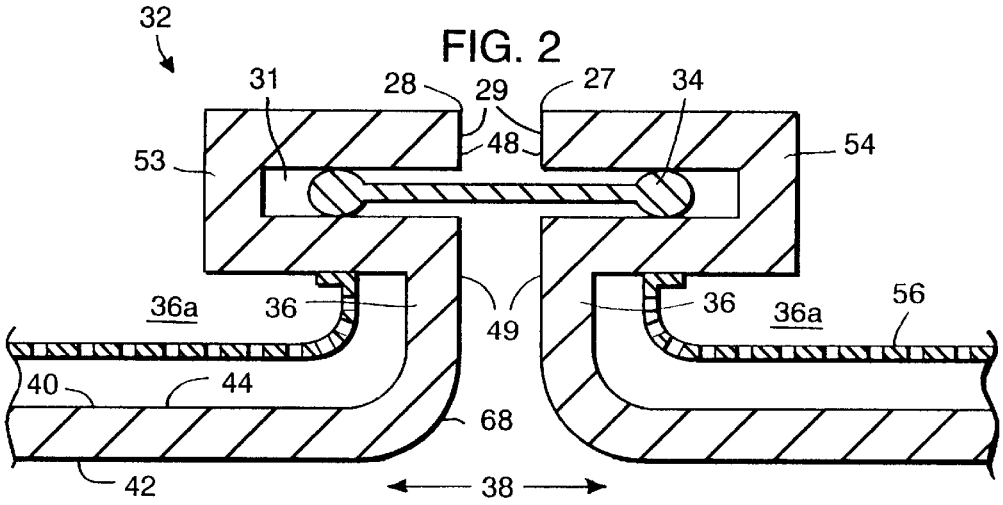
FIG. 2 is a cross sectional view of the abutting nozzle segments taken generally along line 2—2 of FIG. 1

Referring now specifically to FIG. 2, the joint connection between the outer bands 16 of the nozzle segments 10 and 12 is illustrated, wherein the side edge 28 of the outer band 16 of segment 10 substantially abuts the side edge 27 of the outer band 16 of segment 12. A slight leakage gap between the abutting outer bands 16 is exaggerated in FIGS. 2–4 for purposes of illustration only.

The joint connection according to the present invention is embodied in a seal joint 32 including opposed slots 31, which receive a sealing member 34. The seal joint 32 is disposed at distal ends of adjacent radial extension flanges 36, which extend substantially perpendicular to a turbine gas path 38. By virtue of the radial extension flanges 36, the seal joint 32 is spaced away from the gas path 38 by an amount sufficient to enable active cooling of the seal joint 32. That is, the seal joint 32 is spaced from the gas path 38 such that coolant can be directly contacted with the radial extension flanges 36 and the seal joint 32 as opposed to cooling by conduction or the like.

The segmented components each include a longitudinal section 40, which extends substantially parallel to the gas path 38 and is continuous with the radial extension flanges 36 as shown in FIG. 2.

The face 29 of the side edges 27 and 28 is divided by the slot 31 and sealing member 34 into a radially outer face portion 48 and a radially inner face portion 49. By virtue of the radial extension flanges 36, the radially inner face portion 49 is longer than the radially outer face portion 48.

The slot 31 is formed in the adjacent components by one of the adjacent components having a C-shaped section 53, and the other of the components having a reverse C-shaped section 54. The C-shaped section 53 disposed adjacent the reverse C-shaped section 54 delimits the slot 31 receiving the sealing member 34. Sections 53 and 54 are located at distal ends of the flanges 36, and extend substantially parallel to the gas path, such that the slot 31 and sealing member 34 also extend substantially parallel to the gas path. As such, an undercut area 36*a* is defined between the seal joint 32 and the longitudinal section 40.

An impingement plate 56 is mounted to each segment of the seal joint 32 and extends adjacent and substantially parallel to the radial extension flanges 36 and then substantially parallel to the gas path 38 adjacent the longitudinal section 40. Cooling air is flowed through the impingement plates 56 in a conventional manner, providing open-circuit impingement or convection cooling along the longitudinal section 40, the radial extension flanges 36 and the seal joint 32.

Figure 3:
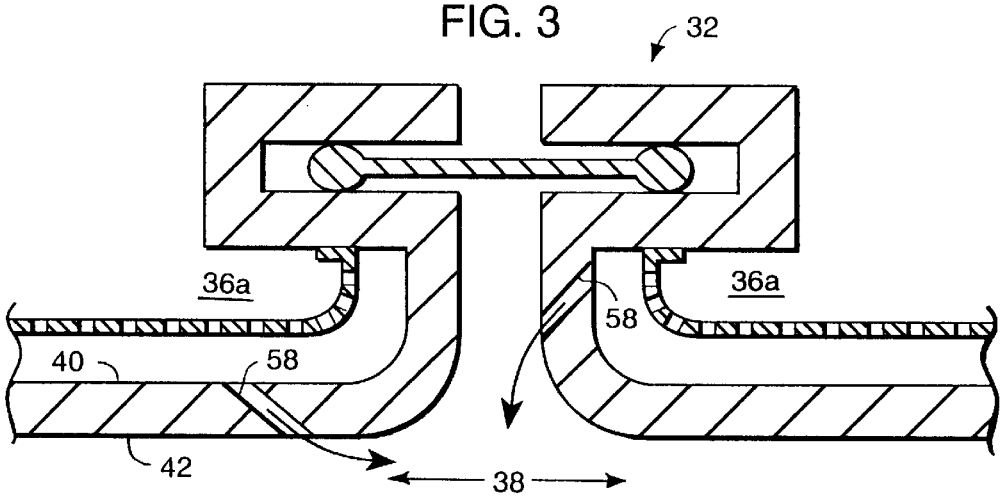
FIG. 3 is a cross sectional view of alternative abutting nozzle segments taken generally along line 2—2 of FIG. 1.

As shown in FIG. 3, in an alternative arrangement, film slots 58 are provided in the longitudinal section 40 to additionally provide conventional film cooling along with the open-circuit impingement or convection cooling. The joint arrangement is otherwise similar to that shown in FIG. 2.

Figure 4:
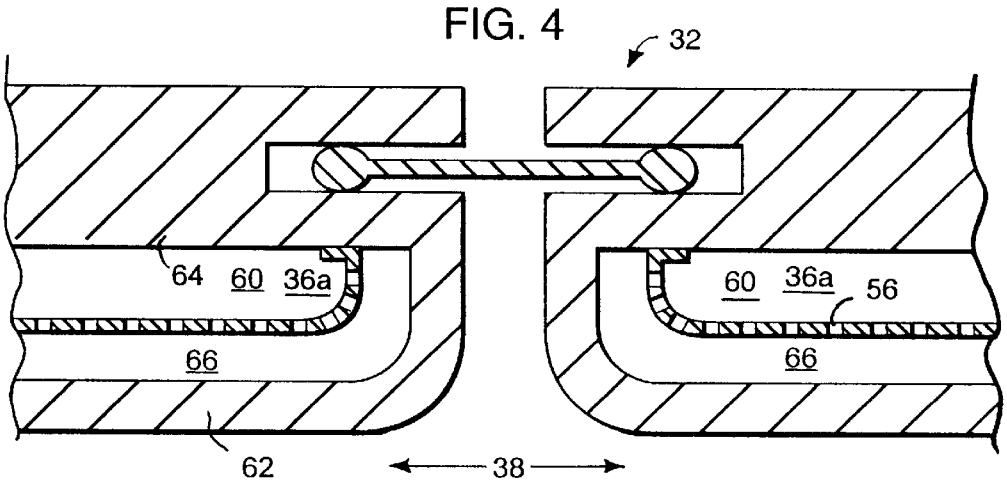
FIG. 4 is a cross sectional view of further alternative abutting nozzle segments taken generally along line 2—2 of FIG. 1.

FIG. 4 illustrates yet another alternative arrangement including a closed annular circuit region 60 providing closed-circuit impingement or convection cooling. The region 60 is defined by an impingement plate 56 and an outer wall portion 64 of the segment. Coolant, such as steam, is directed from a steam circuit into the closed annular circuit region 60 via a pipe. After impingement, the coolant is returned to the steam circuit via path 66 defined between impingement plate 56 and an inner wall portion 62. Steam can be used as the coolant in this configuration because the cooling region is closed from the gas path 38.

As noted above, by virtue of the radial extension flanges 36, the seal joint 32 is spaced from the gas path 38 by an amount sufficient to enable active cooling of the seal joint 32, which is substantially farther away from the gas path than in prior art configurations. Further, the rounded corners 68 tend to reduce conduction of heat through the metal from the hot gas surface 42 to the cold metal surface 44. As a result, excessive thermal gradients are avoided as the entire corner is evenly cooled. Air usage at the joint is bounded by seal leakage with no extra dedicated coolant required.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. In a gas turbine engine including at least one section comprising a plurality of circumferentially adjacent segments, each of said segments comprising:

a longitudinal section extending in a first direction;

a radial extension flange continuous with said longitudinal section and extending in a second direction substantially perpendicular to said first direction; and a seal joint section continuous with said radial extension flange and defining a slot, said slot being shaped to receive a sealing member in cooperation with an adjacent slot of an adjacent segment, wherein said seal joint section is radially spaced from said longitudinal section by an amount substantially corresponding to said radial extension flange defining an undercut area between said longitudinal section and said seal joint section.

2. The segment of claim 1, further comprising an impingement plate secured adjacent said longitudinal section, a portion of said impingement plate extending substantially parallel to said radial extension flange.

3. The segment of claim 2, further comprising at least one film slot extending through said longitudinal section.

4. The segment of claim 2, further comprising a closed circuit cooling region defined in part by said impingement plate.

5. The segment of claim 2, wherein said impingement plate comprises a plurality of coolant flow apertures therethrough.

6. A segmented component of a turbine engine including a plurality of pairs of adjacent segments, each pair of adjacent segments comprising a seal joint having a slot therein shaped to receive a seal member, said seal joint being radially spaced from a gas path defining an undercut area between said seal joint and said gas path sufficient to enable active cooling of said seal joint and said undercut area.

7. The segmented component of claim 6, wherein one of said pair of adjacent segments comprises a substantially C-shaped section and the other comprises a substantially reverse C-shaped section, said C-shaped section and said reverse C-shaped section defining said seal joint, and openings of the C-shape and the reverse C-shape defining said slot.

8. The segmented component of claim 7, wherein each pair of adjacent segments further comprises adjacent radial extension flanges extending substantially perpendicular to said gas path, said seal joint being disposed at a distal end of said adjacent radial extension flanges.

9. The segmented component of claim 8, wherein said adjacent radial extension flanges have a length substantially corresponding to the distance between said seal joint and said gas path.

10. The segmented component of claim 8, further comprising impingement plates secured at one end to said seal joint and extending substantially parallel to said adjacent radial extension flanges and then substantially parallel to said gas path.

11. The segmented component of claim 10, further comprising at least one flow slot defining a coolant flow path between an area adjacent said impingement plates and said gas path.

12. The segmented component of claim 10, further comprising a closed circuit cooling region defined in part by said impingement plates.

13. A segment for a circumferential component of a rotary machine comprising:

a longitudinal section extending in a first direction;

a radial extension flange continuous with said longitudinal section and extending in a second direction substantially perpendicular to said first direction; and a seal joint section continuous with said radial extension flange and defining a slot, said slot being shaped to receive a scaling member in cooperation with an adjacent slot of an adjacent segment, wherein said seal joint section is radially spaced from said longitudinal section by an amount substantially corresponding to said radial extension flange defining an undercut area between said longitudinal section and said seal joint section.

14. A method of sealing and cooling circumferentially adjacent segments in a gas turbine engine, the method comprising:

locating seal joint sections, including seal joint slots in the adjacent segments, radially spaced from a gas path by an amount sufficient to enable active cooling of the seal joint slots; and inserting a sealing member in the seal joint slots of adjacent segments to seal the adjacent segments.

15. A method according to claim 14, further comprising one of open-circuit impingement cooling and convection cooling of the seal joint slots.

16. A method according to claim 15, further comprising film cooling of the seal joint slots.

17. A method according to claim 14, further comprising one of closed-circuit impingement cooling and convection cooling of the seal joint slots.

* * * * *